US005581619A

United States Patent [19]

Shibata et al.

[11] Patent Number: 5,581,619

[45] Date of Patent: Dec. 3, 1996

[54] VEHICLE INTERNAL NOISE REDUCTION SYSTEM AND METHOD

[75] Inventors: Eiji Shibata, Gunma Pref.; Manpei Tamamura, Ohta; Hiroshi Iidaka, Tokyo, all of Japan

[73] Assignee: Fuji Jukogyo Kabushiki Kaisha, Tokyo, Japan

[21] Appl. No.: 264,150

[22] Filed: Jun. 22, 1994

[30] Foreign Application Priority Data

Jul. 1, 1993 [JP] Japan ..... 5-163631

[51] Int. Cl.[6] ..... G10K 11/15; H04B 15/00

[52] U.S. Cl. ..... 381/71; 381/94

[58] Field of Search ..... 381/71, 94, 73.1, 381/86

[56] References Cited

U.S. PATENT DOCUMENTS 5,426,705 6/1995 Yokota ..... 381/71

FOREIGN PATENT DOCUMENTS 2273849 6/1994 United Kingdom ..... 381/94

OTHER PUBLICATIONS

U.S. application Ser. No. 8/154,074, filed Nov. 1993, Yokota et al.

U.S. application Ser. No. 8/214,489, filed Mar. 1994, Iidaka et al.

U.S. application Ser. No. 8/234,018, filed Apr. 1994, Tamamura et al.

U.S. application Ser. No. 8/180,995, filed Jan. 1994, Tamamura et al.

U.S. application Ser. No. 8/135,463, filed Oct. 1993, Yokota et al.

U.S. application Ser. No. 8/032,057, filed Mar. 1993, Tamamura et al.

*Primary Examiner*—Edward L. Coles, Sr.
*Assistant Examiner*—Jerome Grant, II
*Attorney, Agent, or Firm*—Beveridge, DeGrandi, Weilacher & Young, L.L.P.

[57] ABSTRACT

In the noise reduction system to attenuate vehicle internal noise sounds by means of generating a canceling sound synthesized with an engine-originated vibration noise source signal, to prevent a remaining noise sound caused by insufficient follow-up characteristic of the adaptive filter updating at a rapid deceleration or acceleration condition of engine, while a generation of canceling sound and an updating of the adaptive filter are interrupted forcibly, the filter coefficient is reset to be a predetermined level and then therefrom a normal adaptation of the adaptive filter is restarted.

10 Claims, 8 Drawing Sheets

FREQUENCY CHARACTERISTIC OF CMNO

VEHICLE INTERNAL NOISE REDUCTION SYSTEM AND METHOD

BACKGROUND OF THE INVENTION

The present invention relates to a noise reduction system for a passenger compartment of an automotive vehicle by positively generating a sound from a sound source to cancel the vehicle internal noise.

There have been proposed several techniques for reducing the noise sound in the passenger compartment by producing a canceling sound, having the same amplitude as the noise sound and a reversed phase thereto, from a sound source disposed in the passenger compartment.

There are recently vehicle internal techniques for reducing a noise sound noise reduction (Least Means Square) algorithm (a theory by using a LMS filter coefficient by approximating it to for obtaining a means square error in order to simplify an instantaneous that a filter correction formula is a formula, utilizing or by employing a MEFX-LMS (Multiple Error Filtered X-LMS) recursive expression) algorithm. This technique has already been put to a practical use in some of production vehicles.

Commonly, an internal noise reduction system using this LMS algorithm is composed in such a way that: a vibration noise source signal (primary source) is detected from an engine, then the primary source is synthesized with a filter coefficient of an adaptive filter into a canceling sound, then the canceling sound is generated from a speaker to cancel a noise sound in the passenger compartment, further the noise sound reduced by the canceling sound is detected as an error signal by a microphone disposed at a noise receiving point, and based on the detected error signal and a primary source signal synthesized with a speaker microphone transmission characteristic as a finite impulse response, as shown in FIG. 6), a filter coefficient W of the adaptive filter is updated by the LMS algorithm so as to optimize the reduced noise sound at the noise receiving point.

The filter coefficient of the adaptive filter is updated according to the following formula:

$$W_{ik+1}=W_{ik}-\alpha\cdot e_k\cdot C_{MNO}\cdot X_{k-1} \quad (1)$$

where $W_{ik+1}$ is a filter coefficient after updating ("i"th order), $W_{ik}$ is a present filter coefficient, $\alpha$ is a step size which represents an updating ratio of the filter coefficient, $e_k$ is an error signal, $C_{MNO}$ is a series of compensation coefficients ($C_{MNO}=[C_O, C_1, C_2, \ldots, C_j]$), and $X_k$ is an input signal ($X_k=[X_k, X_{k-1}, X_{k-2}, \ldots, X_{k-j+1}]$).

An updating amount of the present filter coefficient $W_k$ becomes large, as the step size $\alpha$ is set to be large and the updating amount of the present filter coefficient $W_k$ becomes small, as $\alpha$ is set to be small.

In the noise reduction system using a prior LMS algorithm, when an error signal $e_k$ varies rapidly by the change of the engine operating condition (for example, during acceleration or deceleration), since an engine noise within the passenger compartment varies more than an updating rate of the adaptive filter which is determined by the above step size $\alpha$, it takes time to update the filter coefficient $W_k$ while following the change of engine noise and to converge at an optimum value.

To overcome this shortfall, as shown in Japanese Patent Application Laid-open No. 178846 (1991) a noise reduction system with a step size which can be varied according to vehicular acceleration or deceleration is proposed. According to this noise reduction system, a larger updating rate of the filter coefficient can be obtained by setting a step size $\alpha$ at a large value with an increase of vehicular acceleration. Therefore, it takes less time to update the filter coefficient and to converge at an optimum value, compared to the prior noise reduction system.

However, the amount of the filter coefficient W is dependent upon the sequence of the compensation coefficients $C_{MNO}$ for compensating speaker/microphone transmission characteristics within the passenger compartment, as easily understood in the above formula (1). The sequence $C_{MNO}$ has a frequency characteristic as shown in FIG. 6, for example. In this example of frequency characteristic, it includes a frequency hard to be transferred from speaker to microphone (frequency B in FIG. 6). For this reason, as indicated in FIG. 7 (*a*), the filter coefficient W is updated largely at the frequency A but it is updated little at the frequency B, as indicated in FIG. 7 (*b*). Even in this case shown in FIG. 7 (*b*), the noise will be reduced gradually by repeated updatings of the filter coefficient W, however, when the noise is sufficiently reduced, the filter coefficient W will grow up into a large value. Once the filter coefficient W grows up into a large value, it takes time for the filter coefficient W to reach an optimum value when the frequency like a frequency B becomes small rapidly due to an abrupt change of engine speed. As a result of this, the insufficiently canceled noise sound will be heard by the driver or passengers during that period.

To solve this problem, it can be considered that the step size $\alpha$ is to be set at a larger value in the above variable $\alpha$ system. However, even in this method, it is necessary to set an upper threshold in the filter coefficient W to be updated, because there is a possibility that the noise reduction system will diverge unless otherwise. Therefore, this method can not be an effective way to solve the problem completely.

SUMMARY OF THE INVENTION

In view of the foregoing disadvantages, an object of the present invention is to provide a vehicle internal noise reduction system which can attenuate a noise sound effectively at transient operating conditions such as abrupt acceleration or deceleration of a vehicle by preventing a noise sound from being insufficiently canceled.

To achieve the above object, the internal noise reduction system according to the present invention is provided with: input signal converting means for processing a vibration noise source signal and for outputting the processed signal as a primary source signal; canceling signal synthesizing means for synthesizing the primary source signal with a filter coefficient and for outputting the synthesized primary source signal as a canceling signal; canceling sound generating means for converting the canceling signal into a canceling sound and for generating the canceling sound; error signal detecting means for detecting a result of interference of the canceling sound and the noise sound and for outputting the result of interference as an error signal; input signal compensating means for compensating the primary source signal with a compensation coefficient and outputting the compensated primary source signal; filter coefficient updating means responsive to the compensated primary source and the error signal for outputting the updated filter coefficient to the canceling signal synthesizing means; engine condition judging means responsive to the primary source signal for outputting a trigger signal when it is judged that a degree of revolutional deceleration of the engine exceeds a predetermined value; switching control means responsive to the trigger signal and the primary source signal for outputting a control signal; output signal switching means responsive to the control signal for switching the canceling signal on or off so as to interrupt generation of the canceling sound; reset control means responsive to the primary source signal and the trigger signal for outputting reset signal so as to reset the filter coefficient; filter coefficient resetting means responsive to the reset signal for resetting the filter coefficient and for transmitting said reset filter coefficient to said canceling signal synthesizing means; and updating interruption means responsive to the reset signal for interrupting an updating of the filter coefficient in the filter coefficient updating means.

Referring now to FIG. 8, in the internal noise reduction system constituted as above, first, a noise sound whose primary source is an engine vibration noise is generated in the passenger compartment. Then, in the canceling signal synthesizing means a vibration noise source signal having a high correlation with an engine vibration noise is synthesized into a canceling signal by an adaptive filter, then in the canceling sound generating means the canceling signal is transformed into a canceling sound, then the canceling sound is generated to cancel the noise sound in the passenger compartment. Next, in the error signal detecting means the state of noise reduction is detected as an error signal. On the other hand, in the filter coefficients updating means, a filter coefficient of the above adaptive filter is updated based on the vibration noise source signal and the error signal.

When the noise sound is changed due to the change of the engine operating condition, while a generation of the canceling sound is interrupted by the output signal switching means, in the filter coefficient resetting means the filter coefficient is set to be a specified initial value, and after that the generation of the canceling sound is restarted.

The advantages of the present invention may be best understood by reference to the following detailed description of the preferred embodiment when considered in conjunction with the accompanying drawings.

DESCRIPTION OF THE PREFERRED EMBODIMENTS

Figure 1:
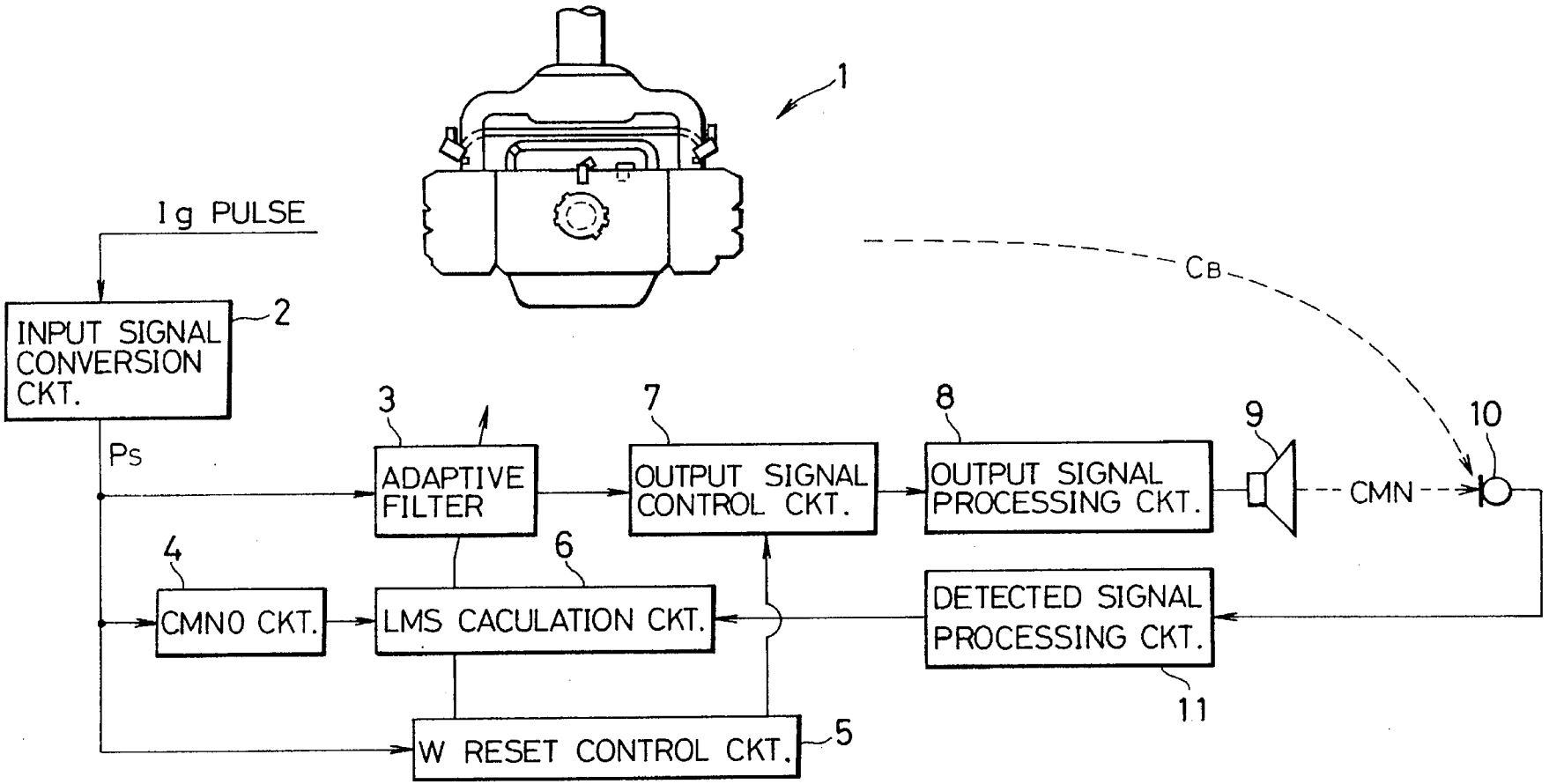
FIG. 1 is a schematic drawing of an internal noise reduction system employed to attenuate engine originated noise in accordance with the principle of the present invention.
Figure 2:
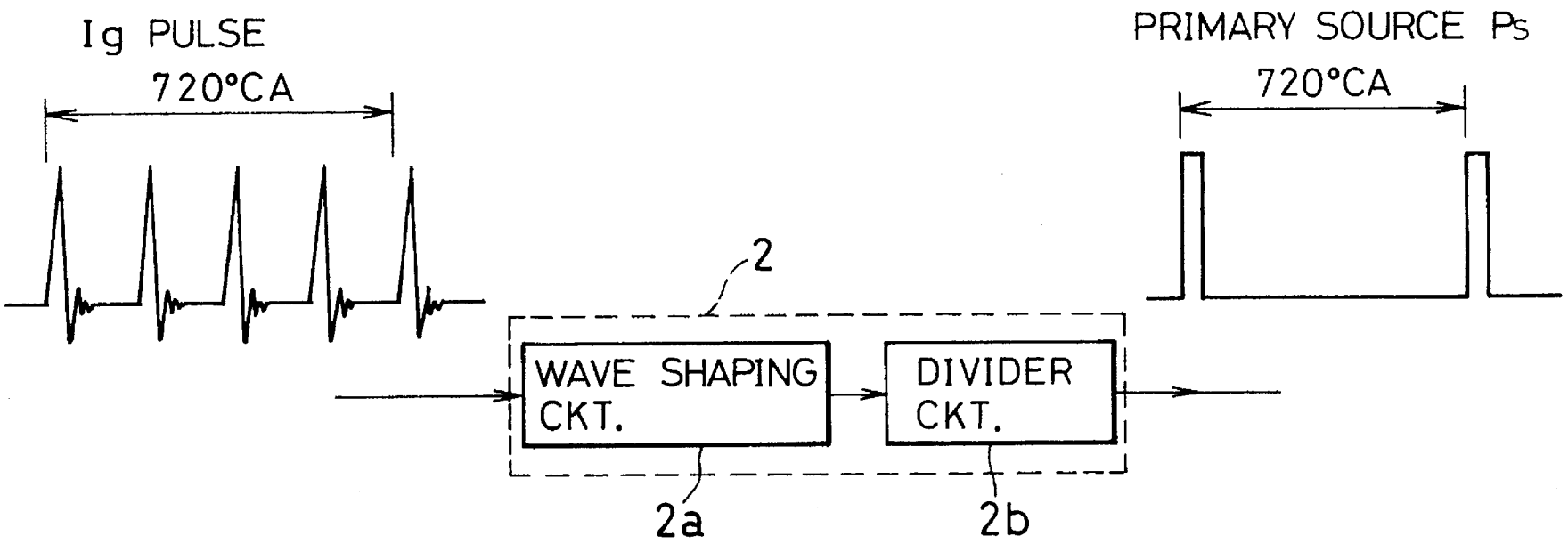
FIG. 2 is a drawing for describing compositions of an input signal conversion circuit according to the present invention.

Referring to FIG. 1, reference numeral 1 denotes a four cycle engine whose ignition pulse signal (hereinafter referred to as "Ig pulse signal") is transmitted to an ignition coil (not shown) and at the same time to an input signal conversion circuit 2 forming input signal converting means, too. This input signal conversion circuit 2 is composed of a waveform shaping circuit 2*a* and a frequency divider circuit 2*b*. The Ig pulse signal is synchronized with an engine revolution and forms one cycle per two engine revolutions. The Ig pulse signal from an engine is inputted to the input signal conversion circuit 2 where the Ig pulse signal is shaped and divided into a single pulse signal composed of 0.5×n (n: integers) order components of engine revolution. The pulse signal is outputted as a vibration noise source signal (primary source $P_s$) to an adaptive filter 3 forming canceling signal synthesizing means, a speaker/microphone transmission characteristic correction circuit (hereinafter referred to as a $C_{MNO}$ circuit) 4 forming input signal compensating means and a W resetting circuit 5 forming filter coefficients resetting means. The vibration noise of the four cycle engine is a noise forming one cycle for every two engine revolutions since the engine 1 has four strokes (induction, compression, explosion and exhaust). According to the frequency domain, this vibration noise is expressed as a frequency spectrum mainly composed of 0.5×n (integers) high order components. Therefore, a primary source $P_s$ having a high correlation with a vibration noise to be reduced can be obtained by shaping and dividing the Ig pulse signal as mentioned above.

Further, the adaptive filter 3 is a FIR (Finite Impulse Response) filter which has a filter coefficient W updated by a LMS calculation circuit 6 forming filter coefficients updating means and has a specified number of taps (for example, 512 taps) therein. The primary source $P_s$ inputted to the adaptive filter 3 is subjected to a convolution sum with the filter coefficients W therein and outputted as a canceling signal to an output signal control circuit 7 forming output signal switching means. Further the canceling signal is converted into a canceling sound in an output signal processing circuit 8 and the canceling sound is generated from a speaker 9 forming canceling sound generating means. The output signal processing circuit 8 is composed of a D/A converter (not shown), an analogue filter circuit (not shown) for shaping wave and for selectively passing a given frequency band, and an amplifier circuit (not shown).

The speaker 9 is disposed, for example, at an inner side of the front door (not shown) or the like. Further, an error microphone 10 forming error signal detecting means is disposed at a noise receiving point (for instance, a position adjacent to a driver' ears) within the passenger compartment. The error signal, namely a signal indicating a noise reduction state, or representing a result of interference between a canceling sound and an engine related vibration noise, is detected by the error microphone 10 and inputted to the LMS calculation circuit 6 via a detected signal processing circuit forming filter coefficient updating means which comprises an amplifier circuit, a filter circuit 18 and an A/D converter.

The output signal control circuit 7 is connected to the W reset control circuit 5 for switching an output from the adaptive filter 3 on or off according to a filter coefficient resetting process as described hereinafter. Further, the W reset control circuit 5 is connected to the LMS calculation circuit 6 for forcibly resetting the filter coefficient W of the adaptive filter 3 at a predetermined initial value (for example, setting all of filter coefficients expressed in frequency domain zero) according to the filter coefficient resetting process.

Further, in the W reset control circuit 5, the pulse interval of the inputted primary source $P_s$ is monitored in order to calculate a degree of acceleration or deceleration of an engine for executing the filter coefficient resetting process as will be described hereinafter.

Figure 6:
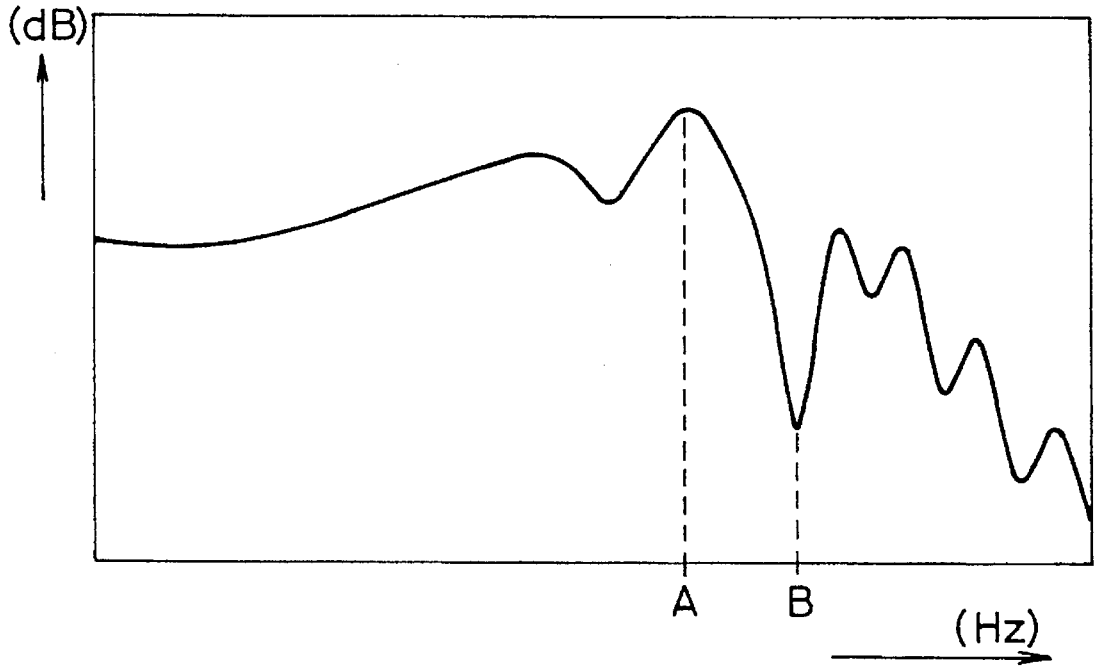
FIG. 6 is an example of a frequency characteristic of a speaker/microphone transmission characteristic.
Figure 7:
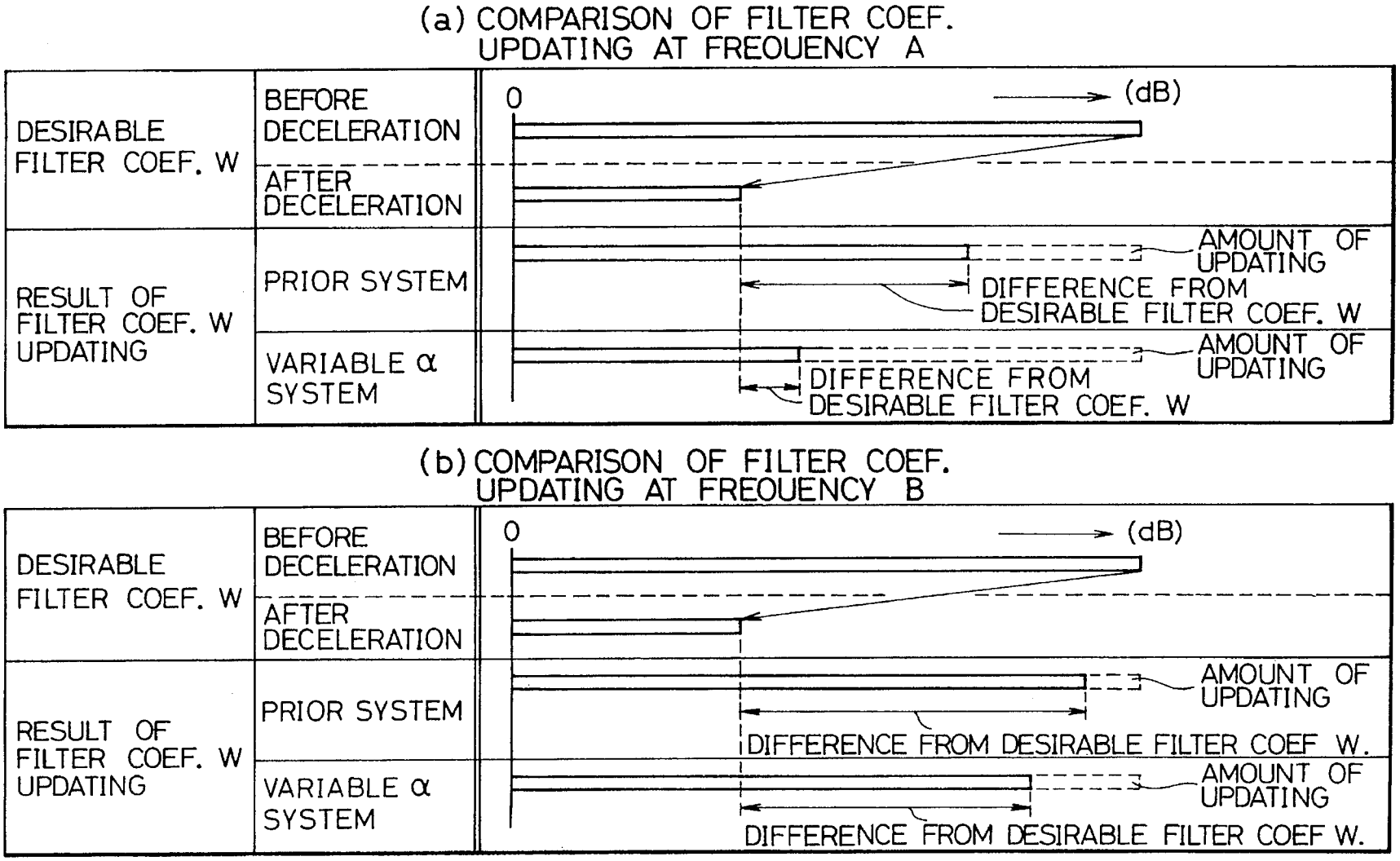
FIG. 7 is a chart for showing a comparison between a prior system and a variable α system.
Figure 8:
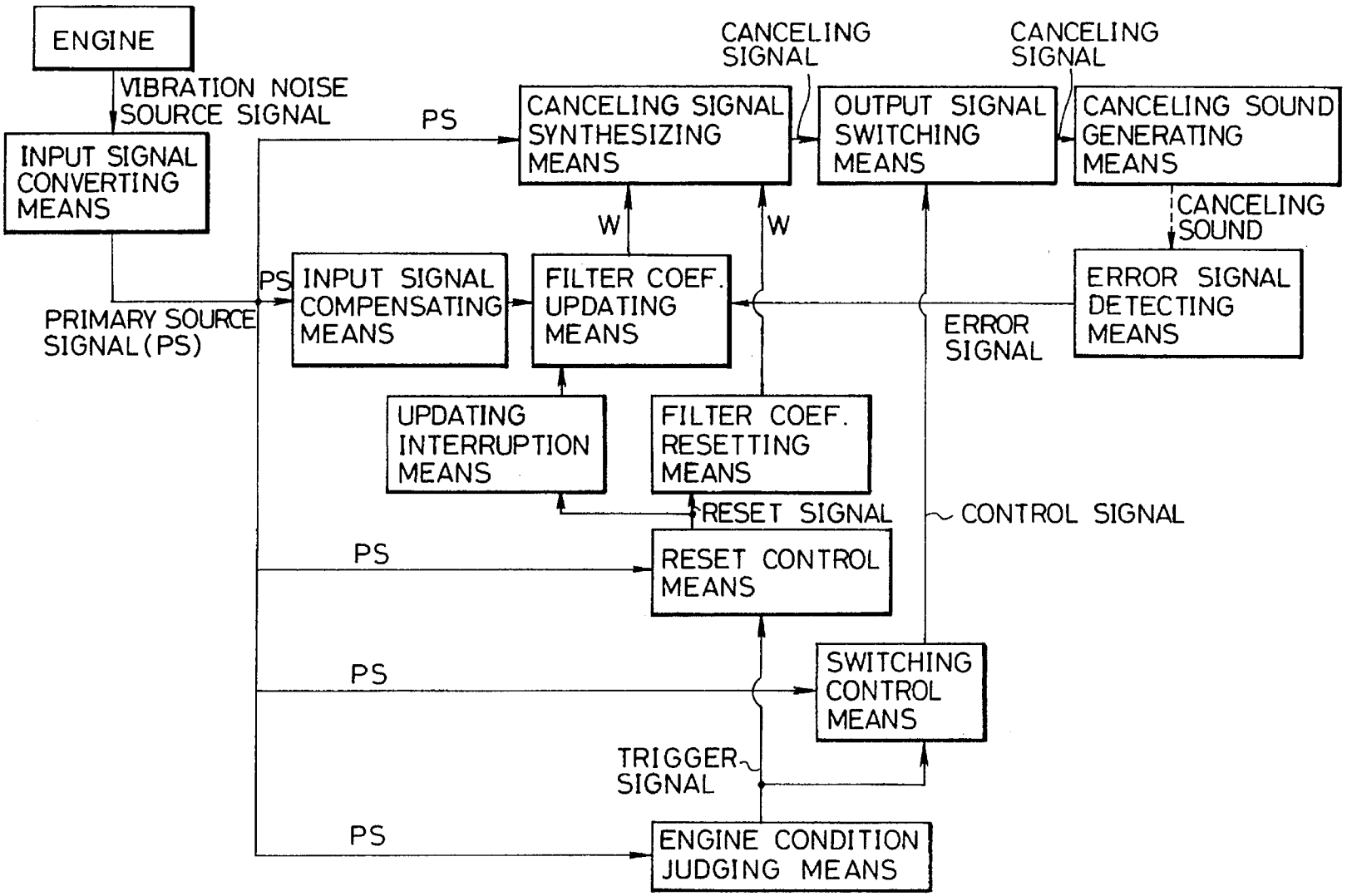
FIG. 8 is a block diagram for showing a constitution of means according to the present invention.

In the $C_{MNO}$ circuit 4, a compensation coefficient $C_{MNO}$ having a frequency characteristic, for example as shown in FIG. 6 are stored in a form of sequence approximated to the finite impulse response. The compensation coefficient $C_{MNO}$ is for compensating a delay time while the signal outputted from the adaptive filter 3 is processed by the output signal control circuit 7 and the output signal processing circuit 8, then generated as a canceling sound from the speaker 9, then detected by the error microphone 10 after being influenced by a speaker/microphone transmission characteristic and inputted to the LMS calculation circuit 6 via the detected signal processing circuit 11, and for compensating deviations of the speaker/microphone transmission characteristic $C_{MN}$ (for example, aged deterioration of a vehicle, temperature change within the passenger compartment, a change of the number of passengers or the like).

The inputted primary source $P_s$ is multiplied (subjected to a convolution sum) by the compensation coefficient $C_{MNO}$ in the $C_{MNO}$ circuit 4 and outputted to the LMS calculation circuit 6 where a correction amount of the filter coefficient of the adaptive filter 3 is calculated based on the error signal from the detected signal processing circuit 11 and the primary source $P_s$ compensated in the $C_{MNO}$ circuit 4 and thus the filter coefficient W is updated.

The reference symbol $C_B$ shown in FIG. 1 indicates a body transmission characteristic with respect to the vibration noise of the engine 1.

Figure 3:
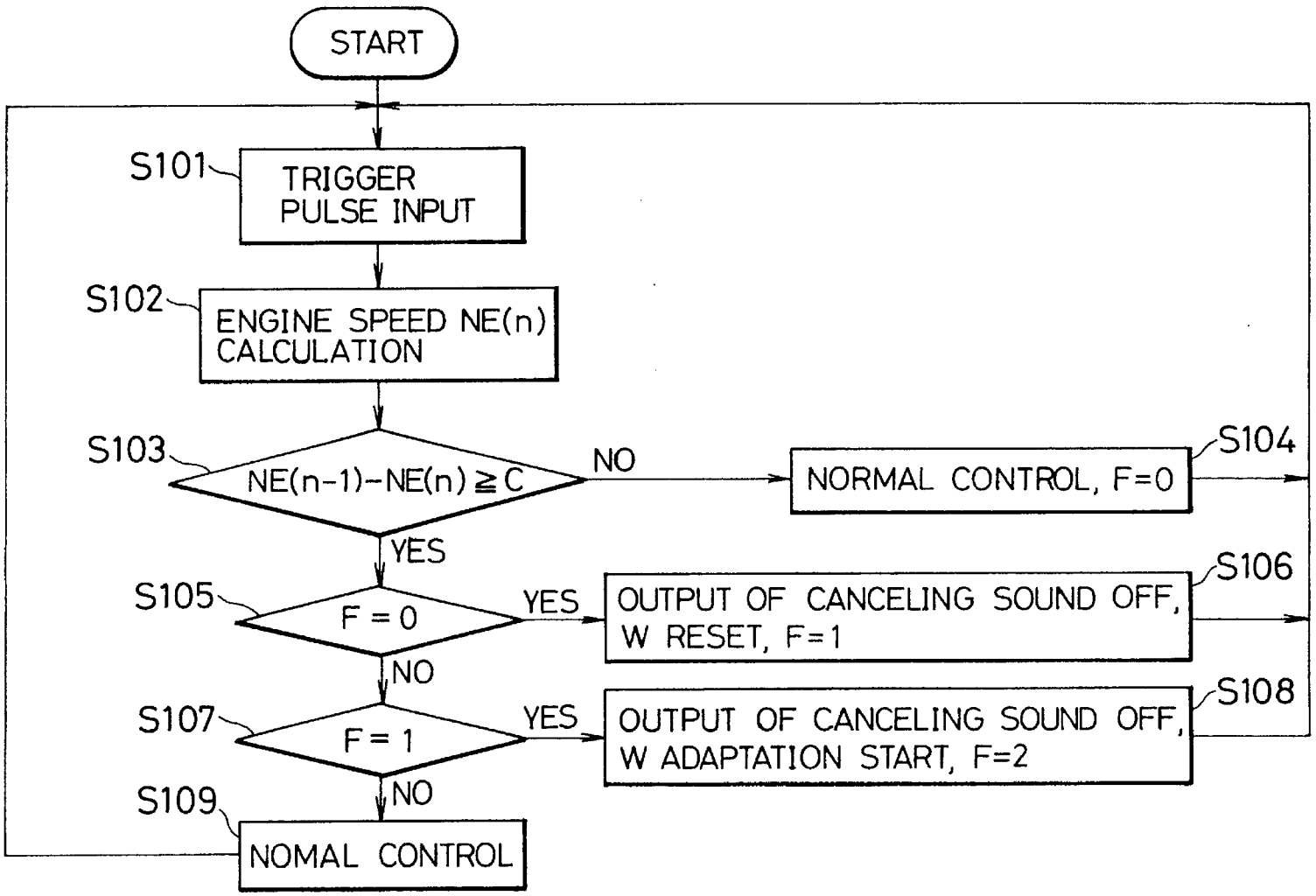
FIG. 3 is a flow diagram for showing a control process in a filter coefficient resetting circuit according to the present invention.

Next, the filter coefficient resetting process will be described according to the flowchart in FIG. 3.

The program is started to be executed when the power switch of the internal noise reduction system is turned on. First, at a step (hereinafter, referred to as "S") 101 a first pulse of the primary source $P_s$ comes in and then the program proceeds to S102 where the present engine revolutional speed $N_E(n)$ is calculated based on the pulse interval of the primary source $P_s$. Next, at S103 the difference between the past engine speed $N_{E(n-1)}$ and the present engine speed $N_{E(n)}$ is obtained. If the difference $N_{E(n-1)}$-$N_{E(n)}$ is smaller than a constant C which has been experimentally predetermined, the program goes to S104 and if it is equal to or larger than C, then it is judged to be a rapid deceleration condition and the program goes to S105.

When the program goes to S103 by judging that the present engine is not at a largely changing operational condition, a normal reduction control (the output signal control circuit 7 is energized to produce a canceling sound from the speaker 9) is performed, then the process returns to S101 after a filter coefficient control flag F is set to be 0.

On the other hand, when the program steps to S105 by judging to be a rapid deceleration condition, it is judged whether or not the filter coefficient control flag F is 0. If F=0, the program (as a first routine) goes to S106 where the output signal control circuit 7 is turned off to cut off the output of canceling sound from the speaker 9 and to reset the filter coefficient $W_k$ in the LMS calculation circuit 6 at a predetermined initial value (for example, resetting all values at a frequency domain at 0, namely, assuming that the filter coefficient $W_K$ to be updated is composed of a sequence $W_1$, $W_2, \ldots, W_{n-1}, W_n$, setting each of the above sequence $W_1$, $W_2, \ldots, W_{n-1}, W_n$ zero at each sampling time). Further, at the same time the filter coefficient control flat F is set to be 1, then the program returns to S101.

If F~0 at S105, the program goes to S107 where it is judged whether or not the filter coefficient control flag F is 1. If F=1, the program (as a second routine) goes to S108 where the output signal control circuit 7 is continued to be turned off with a canceling sound cut off, then the filter coefficient $W_k$ is started to be applied to the LMS algorithm at the LMS calculation circuit 6, then the filter coefficient control flag F is set to be 2, and the program returns to S101.

Further, if F=2 at S107, the program steps to S109 where the control is set to be a state of the normal control, namely the noise reduction control according to a normal LMS algorithm in which the output signal control circuit 7 is turned on and a canceling sound is generated from the speaker 9, and then returns to S101.

The filter coefficient resetting process has been described about the case where an engine is at the deceleration condition of the vehicle, however the filter coefficient resetting process at the acceleration condition is fundamentally similar if the formula of the step S103 is replaced with $N_{E(n)}$-$N_{E(n-1)} \div C_A$, where $C_A$ is an experimentally predetermined constant for judging a state of rapid acceleration.

Next, a function of the preferred embodiment will be described according to the timing chart shown in FIG. 4.

First, an engine vibration noise becomes a noise sound in the passenger compartment after being transmitted from the engine 1 through mountings and also induction and exhaust noise are propagated into the passenger compartment. Any of these engine related noise sounds are mainly composed of frequency spectrum of 0.5×n order (n: integers) components and they reach a noise receiving point (for example, a point adjacent to a driver's ears) after being multiplied by a body transmission characteristic $C_B$ corresponding to each vibration noise source.

On the other hand, the Ig pulse signal to an ignition coil (not shown) of the engine 1 is inputted to the input signal conversion circuit 2 where the Ig pulse signal is shaped and divided into a single pulse signal per two engine revolutions composed of 0.5×n (n: integers) order components of engine revolution by means of the wave shaping circuit 2*a* and the divider circuit 2*b*. The pulse signal is outputted as a vibration noise source signal (primary source $P_s$) to an adaptive filter 3, the $C_{MNO}$ circuit 4 and the W reset control circuit 5.

The primary source $P_s$ inputted to the adaptive filter 3 is subjected to the convolution sum with a filter coefficient W of the adaptive filter 3 and outputted as a canceling signal to cancel the noise sound to the output signal control circuit 7, then outputted to the speaker 9 via the output signal processing circuit 8, and finally outputted as a canceling sound from the speaker 9. The canceling sound reaches the noise receiving point after being influenced by a speaker/microphone transmission characteristic CMN.

At the noise receiving point the engine related noise sound is interfered with by the canceling sound to reduce the noise sound in the passenger compartment and at the same time a result of the interference is detected by the error microphone 10 which is disposed at a position adjacent to the noise receiving point. The detected result of interference is inputted to the LMS calculation circuit 6 via the detected signal processing circuit 11.

Further, the primary source $P_s$ inputted to the $C_{MNO}$ circuit 4 is subjected to the convolution sum with a sequence of the compensation coefficient $C_{MNO}$ and outputted to the LMS calculation circuit 6 where a correction amount of the filter coefficient for the adaptive filter 3 is obtained by the LMS algorithm based on the error signal from the detected signal processing circuit 11 and the primary source signal $P_s$ compensated by the $C_{MNO}$ circuit 4 and then the filter coefficient W is updated.

Figure 4:
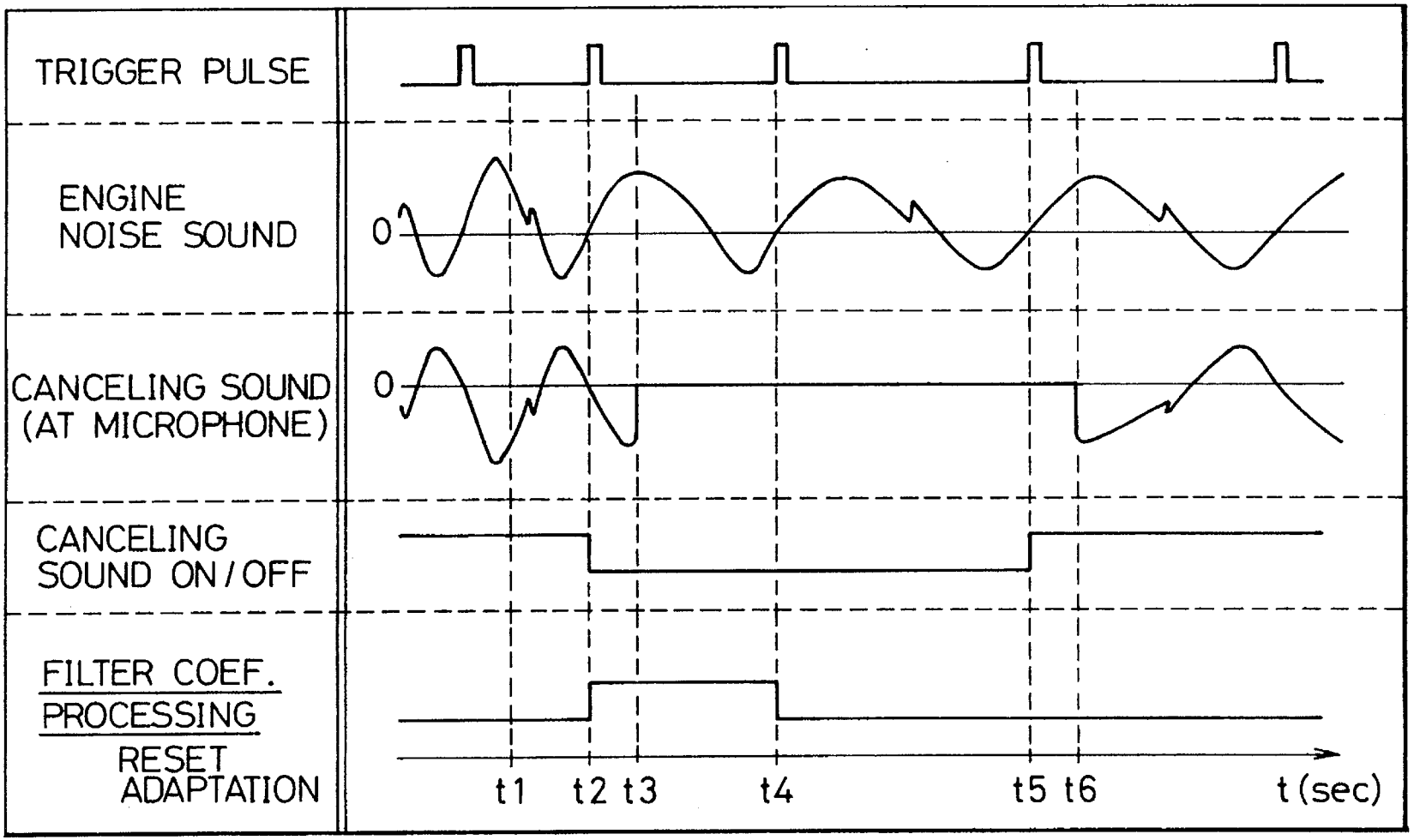
FIG. 4 is a timing chart of a control in the filter coefficient resetting circuit according to the present invention.

Here now, assuming that a rapid deceleration (from 4000 rpm to a closed position of the acceleration pedal, for example) has occurred at the time $t_1$ as indicated in FIG. 4, at the same time the engine related vibration noise is changed subsequently.

Since the pulse interval of the inputted primary source $P_s$ is always monitored to calculate acceleration or deceleration information of the engine revolution $N_E$, deceleration is detected at the time $t_2$ when a first trigger pulse is inputted after the start of this rapid deceleration.

Further, if the degree of this rapid deceleration is larger than the deceleration constant C, the W reset control circuit 5 cuts the output signal control circuit 7 off to discontinue an output of the canceling sound from the speaker 9 and to reset the filter coefficient $W_k$ to be updated at a specified initial value forcibly.

The canceling sound detected by the error microphone 10 is cut off at the time $t_3$, being delayed as much as a time during which a compensation is performed in the $C_{MNO}$ circuit 4.

Next, after the rapid deceleration, when a second trigger pulse is inputted at the time $t_4$, an adaptation of the filter coefficient W is started according to the LMS algorithm in the LMS calculation circuit 6 while the output signal control circuit 7 is turned off and the output of canceling sound from the speaker 9 is discontinued. That is to say, during the period between $t_2$ and $t_4$, the reset control of the filter coefficient W by the W reset control circuit 5 is finished and the adaptation of the filter coefficient W is restarted.

Further, when a third trigger pulse is inputted at the time $t_5$, the output signal control circuit 7 is turned on and the output of canceling sound from the speaker 9 is restarted. The canceling sound is detected at the time $t_6$, being delayed as much as a time during which a compensation is performed in the $C_{MNO}$ circuit 4.

Figure 5:
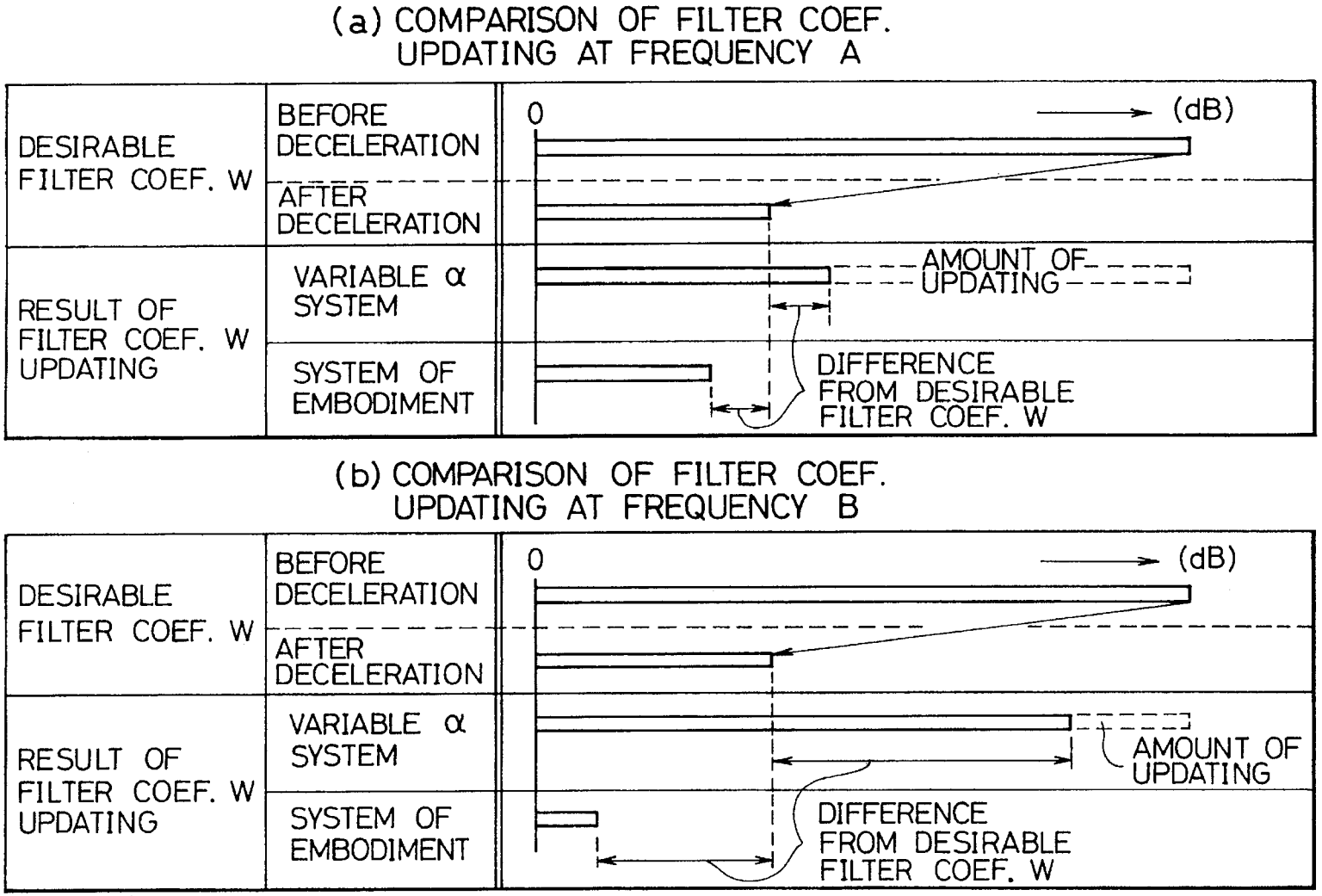
FIG. 5 is a chart for showing a comparison between the preferred embodiment and a variable α system.

Referring now to FIG. 5, a comparison of the result of updating between the aforementioned variable noise reduction system and the embodiment according to the present invention will be made below at the case of frequency A where the filter coefficient W is easy to be updated and at the case of frequency B where the filter coefficient W is hard to be updated.

At the frequency A where the filter coefficient W is easy to be updated, as illustrated in FIG. 5 (*a*), it is understood that the filter coefficient W is updated easily even with the prior variable α system and further the difference between the result of the updated filter coefficient W and a desirable filter coefficient W is almost the same.

However, on the other hand, at the frequency B where the filter coefficient W is hard to be updated, as shown in FIG. 5 (*b*), it is understood that in the prior variable α system the filter coefficient is not updated so much by the influence of a dip in the frequency characteristic of the compensation coefficient sequence $C_{MNO}$ and therefore the difference between the result of the updated filter coefficient W and the desirable filter coefficient W becomes large. However, in case of the preferred embodiment, it is understood that the difference between the result of the updated filter coefficient W and the desirable filter coefficient W becomes larger than the one in the above case of frequency A, but this difference can be made small much faster than in case of the variable α system because the noise control according to the preferred embodiment restarts newly from a standard level (zero level).

In attempting to attenuate a noise sound having a plurality of frequency components under a rapid deceleration, the noise reduction system according to the present invention can converges on a desirable filter coefficient faster, and as a result, it provides an excellent follow-up performance under transient conditions compared to the prior art. Especially when a frequency component at which a filter coefficient is hard to be updated grows up and then suddenly operating conditions are changed, it is necessary to follow properly this frequency component rapidly getting smaller. Even in this case, the noise reduction system according to the present invention does not leave a canceling sound in the form of noise sound.

In this embodiment, an ignition pulse Ig is employed as a primary source Ps, however other signals having a high correlation with an engine related vibration noise, for example, a fuel injection pulse $T_i$ and the like may be used as a primary source $P_s$.

Further, in this embodiment, a noise reduction system using a LMS algorithm of one channel (one microphone and one speaker) has been described, however other noise reduction system using a MEFX-LMS (Multiple Error Filtered X-LMS) algorithm (namely, a multi-channeled LMS algorithm) composed of four microphones and four speakers, for example, can be applied to.

In summary, since the noise reduction system according to the present invention is provided with control means for discontinuing to generate a canceling sound depending on engine operating conditions and therewith resetting a filter coefficient at a specified initial value, an optimization of the filter coefficient can be effectively done under transient conditions, such as rapid acceleration or deceleration, whereby being able to improve a follow-up characteristic of the noise reduction system. While the presently preferred embodiment of the present invention has been shown and described, it is to be understood that this disclosure is for the purpose of illustration and that various changes and modifications may be made without departing from the scope of the invention as set forth in the appended claims.

We claim:

1. A vehicle internal noise reduction system for reducing a noise sound within a passenger compartment by generating a canceling sound based on a vibration noise source signal from an engine, comprising:

input signal converting means responsive to said vibration noise source signal for processing said signal into a pulse train and for outputting a pulse signal as a primary source signal;

canceling signal synthesizing means responsive to said pulse signal for synthesizing said primary source signal with a filter coefficient and for producing a synthesized primary source signal as a canceling signal;

canceling sound generating means responsive to said synthesized primary source signal for converting said canceling signal into a canceling sound and for generating said canceling sound;

error signal detecting means responsive to said canceling sound for detecting a result of interference of said canceling sound and said noise sound and for transmitting said result of interference as an error signal;

input signal compensating means responsive to said pulse signal for compensating said primary source signal with a compensation coefficient and outputting a compensated primary source signal;

filter coefficient updating means responsive to said error signal and sound compensated primary source signal for calculating an appropriate filter coefficient so as to reduce said noise signal to an optimum value and to generate an updated filter coefficient signal;

engine condition judging means responsive to said primary source signal for generating a trigger signal when a deceleration is larger than a first predetermined value;

switching control means responsive to said trigger signal and said primary source signal for generating a control signal;

output signal switching means responsive to said control signal for switching said canceling signal on or off so as to interrupt a generation of said canceling sound;

reset control means responsive to said primary source signal and said trigger signal for producing a reset signal so as to reset said filter coefficient;

filter coefficient resetting means responsive to said reset signal for resetting said filter coefficient and for transmitting a reset filter coefficient to said canceling signal synthesizing means; and updating interruption means responsive to said reset signal for interrupting an updating of said filter coefficient in said filter coefficient updating means.

2. The vehicle internal noise reduction system according to claim 1, wherein said trigger signal is a signal outputted when it is judged that a degree of revolutional acceleration of said engine exceeds a second predetermined value.

3. The vehicle internal noise reduction system according to claim 1, wherein the system comprises one channel employing a LMS algorithm.

4. The vehicle internal noise reduction system according to claim 1, wherein the system comprises a plurality of channels employing a Multiple Error Filtered X-LMS algorithm.

5. The vehicle internal noise reduction system according to claim 1, wherein said canceling sound generating means comprises at least one speaker.

6. The vehicle internal noise reduction system according to claim 1, wherein said error signal detecting means comprises at least one microphone.

7. The vehicle internal noise reduction system according to claim 1, wherein said vibration noise source signal is an ignition timing signal.

8. The vehicle internal noise reduction system according to claim 1, wherein said vibration noise source signal is a fuel injection place signal.

9. A method of reducing a noise sound within a passenger compartment for a vehicle by generating a canceling sound based on a vibration noise source signal from an engine, comprising the steps of:

processing said vibration noise source signal and outputting said processed signal as a primary source signal;

synthesizing said primary source signal with a filter coefficient and outputting said synthesized primary source signal as a canceling signal;

converting said canceling signal into a canceling sound and generating said canceling sound;

detecting a result of interference of said canceling sound and said noise sound and outputting said result of interference as an error signal;

compensating said primary source signal with a compensation coefficient and outputting said compensated primary source signal;

based on said compensated primary source and said error signal, outputting said updated filter coefficient;

based on said primary source signal, outputting a trigger signal when it is judged that a degree of revolutional deceleration of said engine exceeds a first predetermined value;

based on said trigger signal and said primary source signal, outputting a control signal;

based on said control signal, switching said canceling signal on or off so as to interrupting a generation of said canceling sound;

based on said primary source signal and said trigger signal, outputting a reset signal so as to reset said filter coefficient;

based on said reset signal, resetting said filter coefficient and transmitting said reset filter coefficient; and based on said reset signal, interrupting an updating of said filter coefficient.

10. The method according to claim 9, wherein said trigger signal is a signal outputted when it is judged that a degree of revolutional acceleration of said engine exceeds a second predetermined value.

* * * * *